US006073662A

United States Patent [19]

Herbepin et al.

[11] Patent Number: 6,073,662

[45] Date of Patent: Jun. 13, 2000

[54] HOOK SELECTION DEVICE FOR A WEAVING LOOM DOBBY HEAD

[75] Inventors: Pascal Herbepin, Venissieux; Jean-Pierre Cloarec, Genas, both of France

[73] Assignee: T. I. S., Beligneux Bressoles, France

[21] Appl. No.: 08/983,546

[22] PCT Filed: Jul. 5, 1996

[86] PCT No.: PCT/FR96/01061

§ 371 Date: Jan. 30, 1998

§ 102(e) Date: Jan. 30, 1998

[87] PCT Pub. No.: WO97/03237

PCT Pub. Date: Jan. 30, 1997

[30] Foreign Application Priority Data

Jul. 13, 1995 [FR] France ..... 95 08767

[51] Int. Cl.[7] ..... D03C 3/20

[52] U.S. Cl. ..... 139/455; 139/66 R; 335/181; 335/256; 66/221

[58] Field of Search ..... 139/66 R, 455; 335/256, 181; 66/221

[56] References Cited

U.S. PATENT DOCUMENTS

| | | | |
|---|---|---|---|
| 3,998,073 | 12/1976 | Luth | 66/221 |
| 4,515,186 | 5/1985 | Durville et al. | 139/455 |
| 4,790,154 | 12/1988 | Lonati | 66/221 |
| 4,969,490 | 11/1990 | Seiler | 139/455 |
| 5,419,162 | 5/1995 | Gaiardo | 66/221 |
| 5,488,977 | 2/1996 | Vinciguerra | 139/455 |
| 5,860,454 | 1/1999 | Mista et al. | 139/455 |

FOREIGN PATENT DOCUMENTS

| | | |
|---|---|---|
| A1 0-108700 | 5/1984 | European Pat. Off. . |
| 2-476694 | 8/1981 | France . |
| C1 43-09983 | 3/1994 | Germany . |
| 2-247694 | 3/1992 | United Kingdom . |

*Primary Examiner*—Andy Faiik
*Attorney, Agent, or Firm*—Oliff & Berridge, PLC

[57] ABSTRACT

A hook selection device for a weaving loom dobby head where the dobby includes a bottom board carrying hooks and an upper part for supporting the selection device. The upper part moves relative to the bottom board and includes rigid heald shafts provided with a catch corresponding to each hook on the bottom board. The position of each catch relative to a corresponding hook being controlled by an electromagnetic device having a coil. Each rigid heald shaft has a portion made of magnetic material and is mounted on the upper part so as to pivot about a pin. The selection device creates a permanent magnetic field in a region of the selection device having the heald shaft. The coil and permanent magnetic field drive the heald shaft to pivot either into a first position to permit entrainment of a catch and corresponding hook and a second position which does not permit entrainment.

10 Claims, 4 Drawing Sheets

HOOK SELECTION DEVICE FOR A WEAVING LOOM DOBBY HEAD

BACKGROUND OF THE INVENTION

The present invention relates to a device for the selection of hooks in a dobby of a loom.

Such a device is used in the textile industry for the purpose of allowing production of fashioned woven fabrics, that is to say requiring a very large number of warp yarns which have to be raised or lowered. Such woven fabrics constitute, for example, paintings, tapestries or other pictures for which hand looms are still often used.

It has been proposed in document FR 2,476,694 to produce a warp-yarn control device for the purpose of opening the shed, by dividing this device into separable modules each including heald shafts which pass through a first board provided with bars and a second board provided with holes. The heald shafts each carry a shoe and a hook. When electromagnets attract heald shafts, the hooks of those which are called are moved by the first board while those which are not called follow the translational movement of the second board. Thus, the shed is opened by the translational movement of the two boards.

Such a dobby is very complicated and requires great accuracy in producing all its elements for the purpose of guaranteeing the relative position of each heald shaft with respect to its electromagnet and its lifting board. This dobby is provided with a large number of movable elements in such a way that, in order to prevent any premature wear and for the purpose of obtaining the accuracy essential for producing all the elements, such a dobby ends up being very expensive.

Document EP-0,108,700 discloses a device for the selection of hooks in a dobby which includes a bottom board carrying the hooks and an upper part which supports the selection device and can move with respect to the bottom board, this device including pieces provided with a catch, each of these pieces corresponding to one hook of the bottom board and the position of the catch with respect to the hook being controlled by an electromagnetic device having at least one coil, in such a way that, when the bottom board moves away from the upper part, the catch, depending on its position, entrains or does not entrain the hook with it.

In this device, the pieces provided with a catch are elastic heald shafts. The latter are elastically deformed when the bottom board moves towards the upper part. The heald shafts then come to bear against a pole piece of a permanent magnetic circuit. The heald shafts are held in this position, which does not allow retention of the hooks of the bottom board. Corresponding to each heald shaft there is therefore a coil which is excited when the heald shaft has to retain a hook of the bottom board, allowing the heald shaft to resume its non-deformed position.

When magnetic dust particles become stuck on a pole piece of the permanent magnetic circuit, it may happen that the corresponding heald shaft is then no longer held in its deformed position and therefore this heald shaft retains each time the corresponding hook of the bottom board. This then causes a defect in the weaving of the woven fabric.

Furthermore, in order to deform the elastic heald shaft, an inclined ramp is provided in the region of each hook of the bottom board. In order to avoid a shock when the bottom board moves towards the upper part, the slope of this ramp is small. In order to obtain sufficient deformation of the heald shaft, the relative stroke between the bottom board and the upper part must be relatively long. Since the stroke is long, the time to cover it is also long and, consequently, the time for inserting the weft is limited.

SUMMARY OF THE INVENTION

The object of the invention is therefore to provide a selection device allowing these drawbacks to be remedied, that is to say a device which is reliable and requires only a short stroke in order to be able to retain the selected hooks of the bottom board, and which increases the time available for insertion of the weft.

For this purpose, the device proposed by the invention is a device for the selection of hooks in a dobby which includes a bottom board carrying the hooks and an upper part which supports the selection device and can move with respect to the bottom board, this device including pieces provided with a catch, each of these pieces corresponding to one hook of the bottom board and the position of the catch with respect to the hook being controlled by an electromagnetic device having at least one coil, in such a way that, when the bottom board moves away from the upper part, the catch, depending on its position, entrains or does not entrain the hook with it.

According to the invention, each piece provided with a catch is a rigid heald shaft which includes at least one piece made of magnetic material, mounted so as to pivot about a pin, the device includes means for creating a permanent magnetic field in the region of the piece made of magnetic material of the heald shaft and the coil makes it possible to act on the piece of the heald shaft made of magnetic material in such a way that, depending on the polarities of the coil and of the permanent magnetic field, the heald shaft pivots about its pin either in a first position allowing entrainment of the corresponding bottom hook when the bottom board moves away from the upper part or in a second position which does not allow such entrainment.

The rigid heald shaft then pivots between two stable positions about a pin which may be real or virtual. These positions depend on the polarities of the permanent magnetic field and of the coil. The polarity of the permanent magnetic field is constant while that of the coil depends on the direction of the current passing through it. When the current supplied to the coil is cut, whatever the position of the rigid heald shaft, the latter remains in its position. Compared to the known devices, the device according to the invention is thereby more reliable.

In addition, the relative stroke between the bottom board and the upper part is limited. It is sufficient in fact for the catch of the pivoting heald shaft to come opposite the hook of the bottom board in order to be able to select the hook or not.

Advantageously, the heald shaft provided with a catch is made of a material having no magnetic property on the same side as the catch and of a magnetic material on the side opposite from the catch. In this way, the elements allowing control of the position of the rigid heald shaft are remote from the catch and consequently less exposed to dust and other foreign bodies which may disturb the operation of the selection device.

There are several ways of arranging the coil and of creating the permanent magnetic field, necessary for the hook selection device. The invention therefore proposes several embodiments.

According to a first embodiment, the electromagnetic control device includes two pole pieces between which lies a permanent magnet and between which part of the piece of the heald shaft made of magnetic material can move and the coil surrounds part of the piece of the heald shaft made of magnetic material. In this case, the permanent magnet creates the permanent magnetic field and the coil makes it possible to polarize the piece of the heald shaft made of magnetic material.

According to a second embodiment proposed by the invention, the electromagnetic control device includes two pole pieces between which lies a second coil and between which part of the piece of the heald shaft made of magnetic material can move as well as the coil surrounding part of the piece of the heald shaft made of magnetic material. Here, the second coil replaces the permanent magnet of the first embodiment.

In these two embodiments, the pole pieces may be common to several pieces provided with a catch. This is advantageous from the standpoint of the cost of the device, since the number of pieces is limited. However, when the hooks of the dobby are very close to each other magnetic interference may occur.

In a third embodiment, the piece of the heald shaft made of a magnetic material is a permanent magnet and the electromagnetic control device includes two pole pieces between which lies the coil and between which part of the permanent magnet can move. Contrary to the previous embodiments, the polarity of the piece of the heald shaft made of magnetic material has a constant polarity and the polarity of the pole pieces varies as a function of the direction of the current flowing in the coil. Furthermore, the devices for selecting each hook are independent of each other.

In these three embodiments, the two pole pieces advantageously serve as a mechanical stop to the rigid pivoting heald shaft and thus define the two positions which the latter can assume. Thus the number of pieces of the device is limited.

In order to ensure better guiding of the pivoting heald shafts, the invention proposes two other embodiments in which, when the heald shaft pivots, it is not only attracted into its new position but it is also repelled from its initial position.

In this first embodiment, each heald shaft has, on the opposite side from the catch, a housing which accommodates a permanent magnet placed between two pole pieces which project out of the housing and the electromagnetic control device includes an E-shaped armature as well as the coil surrounding the central branch of the E, the end of each pole piece projecting out of the housing lying between two branches of the E.

In the other embodiment, each heald shaft has, on the opposite side from the catch, a housing which accommodates an E-shaped armature, the coil surrounding the central branch of the E and a permanent magnet placed between two pole pieces faces this armature in such a way that one end of each pole piece lies between two branches of the E.

In these two latter embodiments, the device is, as for all the devices according to the invention, bistable but also double-acting. In addition, the heald shaft has two stop points in each of its two stable positions, this being favorable from a mechanical standpoint.

In order to adjust the attractive force between the pole pieces and the armature, an air gap made of a non-magnetic material is placed between each end of a pole piece and the neighboring branches of the E-shaped armature.

Advantageously, the selection of the hooks is managed electronically. In this case then, the electromagnetic control device is equipped with an electronic card which includes a printed circuit for controlling the passage of the current through the coil, allowing selection of the position of the heald shaft. The selection of the hooks can thus be very rapid.

BRIEF DESCRIPTION OF THE DRAWINGS

In any case, the invention will be easily understood by means of the description which follows, with reference to the appended diagrammatic drawing representing, by way of non-limiting examples, a hook selection device according to the invention and two alternative forms.

DETAILED DESCRIPTION OF THE INVENTION

Figure 1:
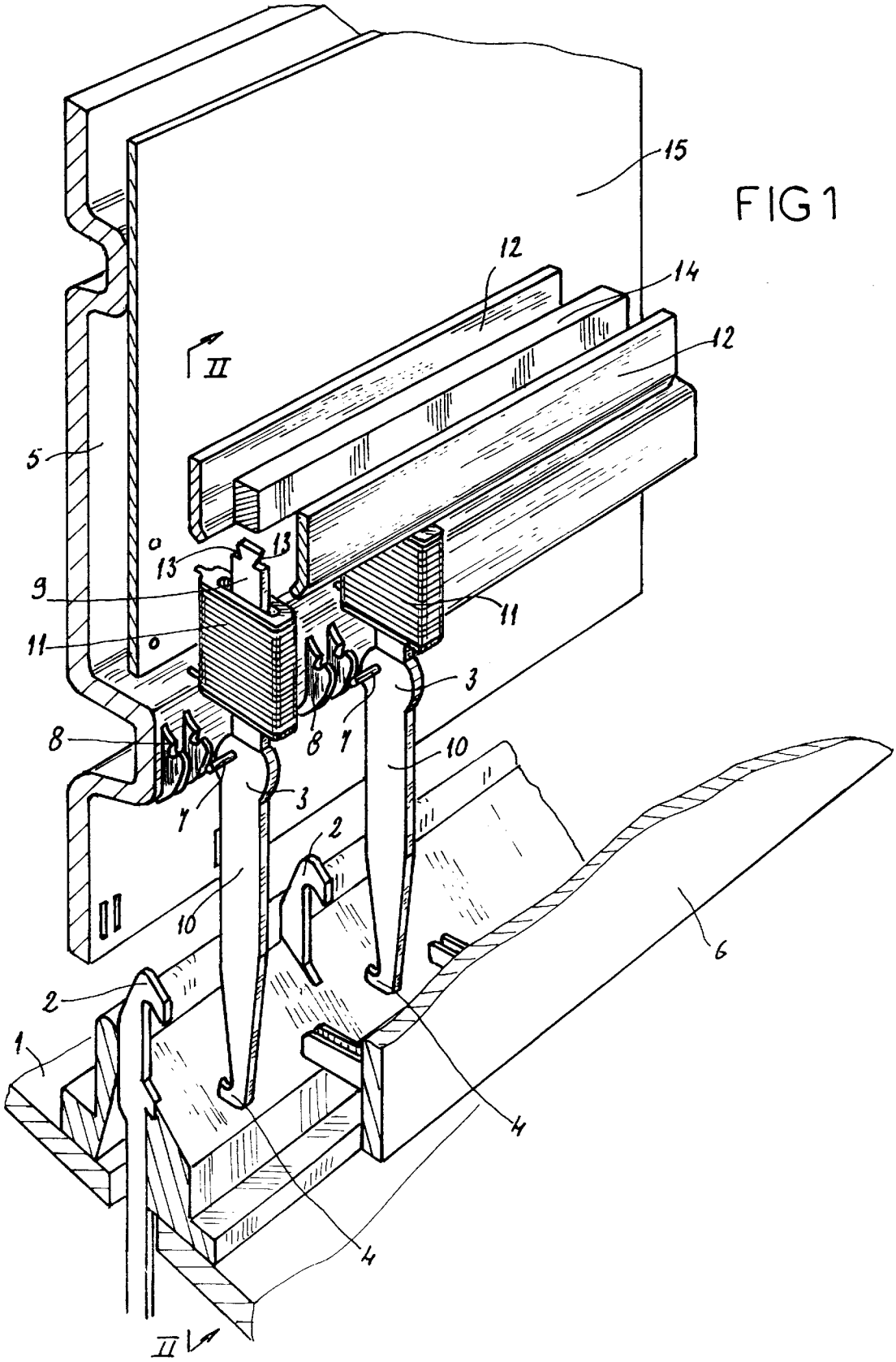
FIG. 1 is an exploded perspective view of a device for the selection of hooks according to the invention.

The hook selection device shown in the drawing is intended to equip a dobby used in the textile industry for weaving. This dobby includes a bottom board 1 carrying hooks 2 and an upper part which supports the device for selecting the hooks 2. The bottom board 1 and the upper part can move with respect to each other, these two elements being able to move towards or away from each other. When they move away, the selected hooks 2 are retained by the selection device while the hooks 2 not selected follow the movement of the bottom board 1.

The hook selection device includes heald shafts 3. Each of the latter corresponds to a hook 2. It is provided at its end facing the hook 2 with a catch 4 intended to engage with the hook 2 when the latter is to be selected.

The heald shafts 3 are mounted so as to pivot in a box 5 provided with a cover 6. Each heald shaft 3 is equipped with a transverse pin 7 mounted on bearings 8 made on one wall of the box.

Each heald shaft is made of two separate materials. On one side, the heald shaft is made of synthetic material and on the other side it is made of a magnetic material, such as soft iron; the part 9 of the heald shaft made of soft iron serves to control the position of the heald shaft 3. The other part 10 includes the catch 4 and faces the hook 2. This part 10 is, for example, overmolded at one end of the part 9 made of soft iron. The pin 7 lies approximately level with the junction between the part 9 made of soft iron and the part 10 made of synthetic material.

Figure 2:
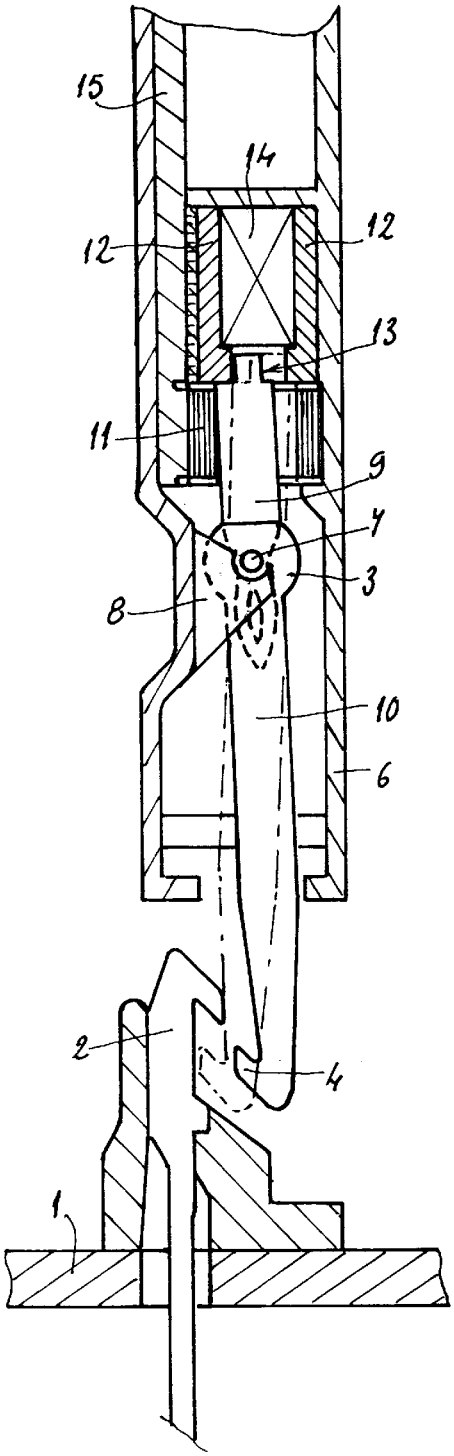
FIG. 2 is a view in cross-section on the line II—II of FIG. 1.

In the embodiment shown in FIGS. 1 and 2, the part 9 of the heald shaft made of soft iron is placed in a coil 11. The end of the heald shaft opposite the catch 4 extends beyond the coil 11. It is placed between two pole pieces 12. The latter serve as stops to the heald shaft 3 when it pivots about the pin 7. Two notches 13 are provided on the heald shaft 3 in order to house the end of the pole pieces 12. Placed between these pole pieces 12 is a permanent magnet 14 which polarizes these pole pieces 12.

A DC current can be passed through the coil 11. An electronic card 15, which includes a printed circuit, manages the passage of the current through the coil 11. Depending on the direction of the current flow through the coil 11, the part 9 of the heald shaft 3 made of soft iron will be polarized and its end placed between the pole pieces 12 is then either a magnetic north pole or a south pole. Depending on the polarization of this part 9 made of soft iron, the heald shaft 3 assumes one or other of the positions shown in FIG. 2. In the position shown in solid lines, the catch 4 of the heald shaft does not catch onto the hook 2 when the upper part moves away from the bottom board 1, while in the position shown in dotted lines the catch 4 remains caught and the hook 2 is then entrained by the upper part.

As may be seen in FIG. 2, it is sufficient for the catch 4 to pass under the hooked part of the hook 2 in order to select this hook or not. The stroke of the upper part with respect to the bottom board 1 may therefore be reduced to the minimum necessary.

Figure 3:
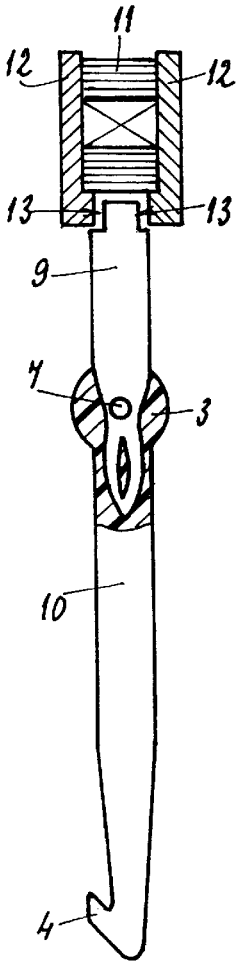
FIGS. 3 and 4 are simplified views corresponding to FIG. 2 and showing alternative forms.
Figure 4:
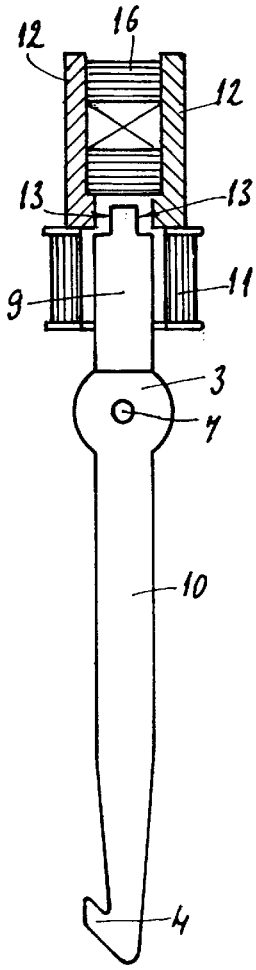

In FIGS. 3 and 4 illustrating alternative forms, only the heald shaft 3 and the device for controlling the position of this heald shaft have been shown.

In FIG. 3, the magnetic part 9 of the heald shaft is a permanent magnet. As previously, this part 9 of the heald shaft is placed between two pole pieces 12. As regards this coil 11, this is placed between the two pole pieces 12.

In this case, the polarity of the part 9 of the heald shaft made of magnetic material is constant and the polarity of the pole pieces 12 varies.

In the alternative form shown in FIG. 4, with respect to the device of FIGS. 1 and 2, only the permanent magnet 14 is replaced by a second coil 16. The latter acts in the same way as the permanent magnet.

Figure 5:
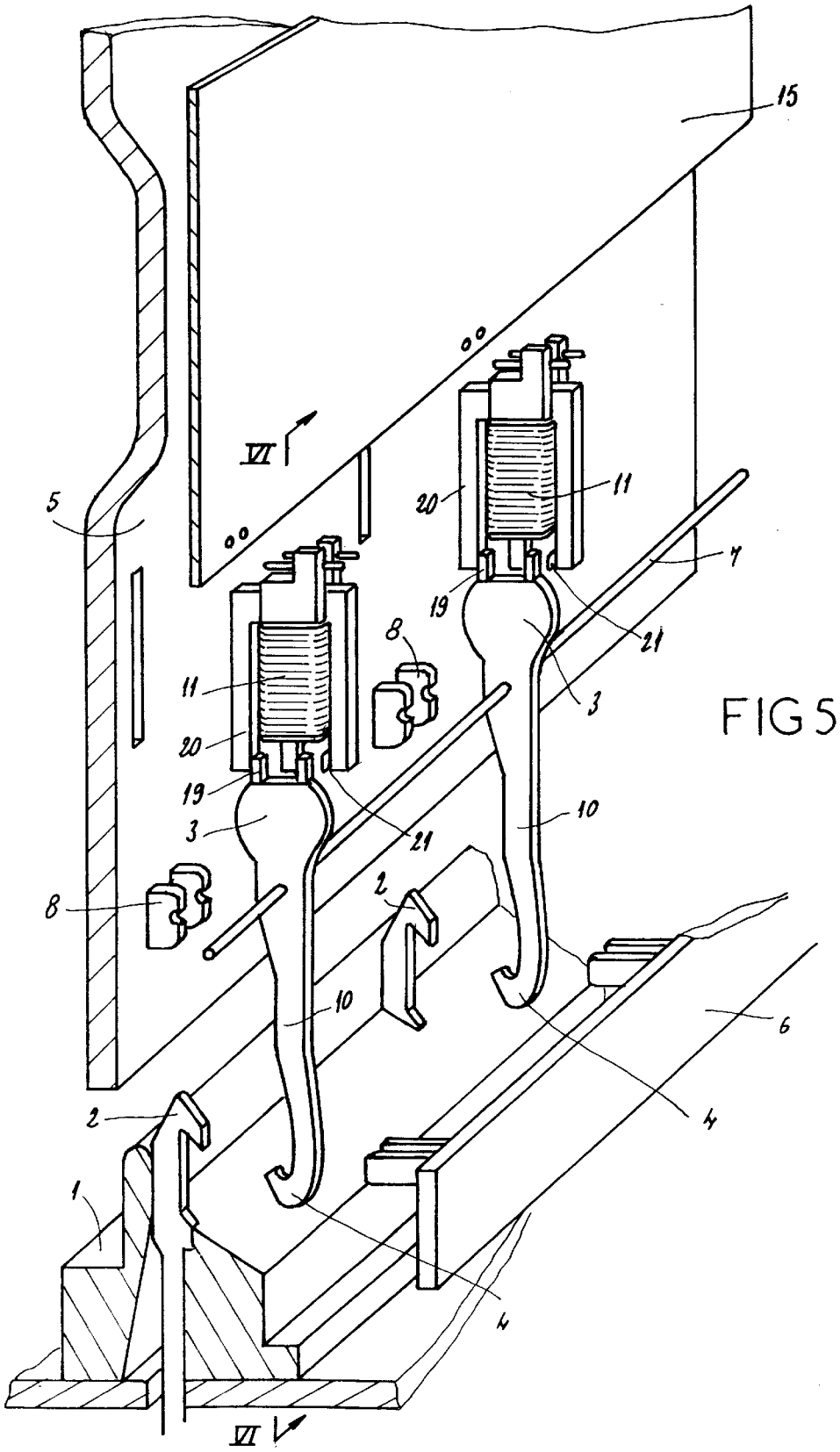
FIG. 5 is an exploded perspective view corresponding to FIG. 1 of another hook selection device according to the invention.
Figure 6:
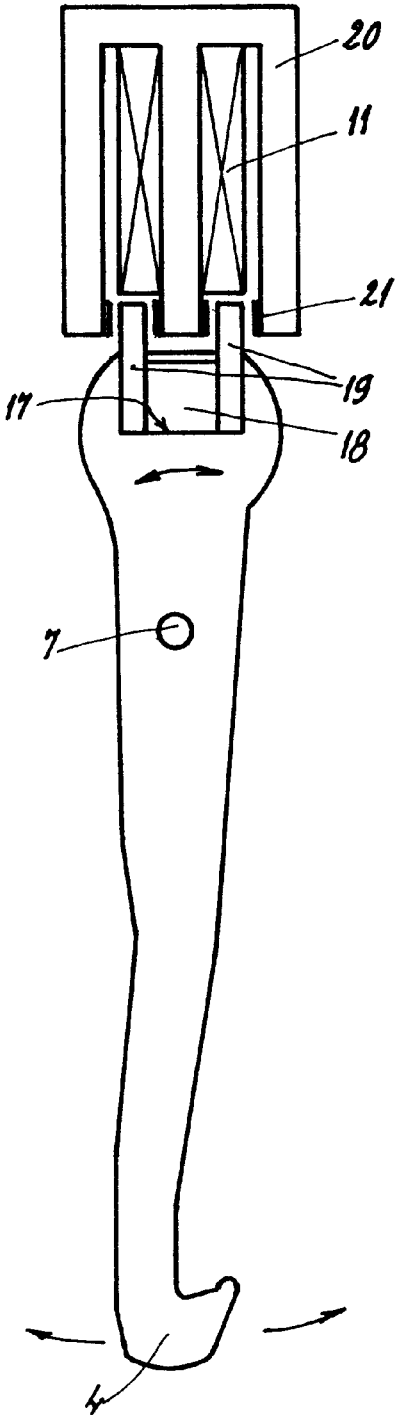
FIG. 6 is a simplified view, on a larger scale, in section on the line VI—VI of FIG. 5.

FIGS. 5 and 6 show a fourth embodiment. Compared to FIG. 1, the main difference resides in the fact that, on the one hand, two successive hook selection devices are magnetically independent of each other and, on the other hand, the devices shown are double-acting devices.

Here, the heald shafts 3 include a housing 17 on the opposite side from the catch 4. A permanent magnet 18 is placed between two pole pieces 19 inside this housing 17. The magnet does not extend beyond the housing 17, but one end of each pole piece 19 projects out of this housing.

Facing the heald shaft 3, on the same side as the magnet 18 and the pole pieces 19, are an armature 20 and the coil 11.

The armature 20 has the shape of an E, the tines of which are oriented towards the heald shaft 3. Between two branches of the E lies each time one end of a pole piece 19. The central branch of the E carries the coil 11.

An air gap 21, made of a non-magnetic material, is placed on each face of a branch of the E facing a pole piece 19.

Figure 7:
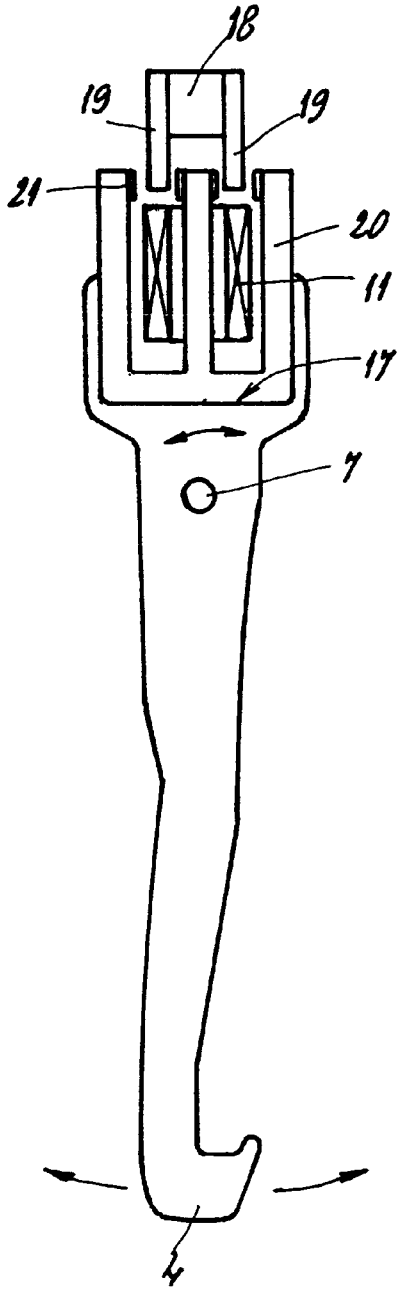
FIG. 7 is a simplified view corresponding to FIG. 6 of another embodiment.

FIG. 7 shows an alternative form of the embodiment of FIGS. 5 and 6. In this alternative form, the armature 20 and the coil 11 are placed in the housing 17, while the permanent magnet 18 and the pole pieces 19 face the heald shaft 3.

The operating principle of these devices (FIGS. 5 to 7) is similar to the principle described hereinabove with reference to FIGS. 1 to 4.

The polarity of the central branch of the armature depends on the direction of the current through the coil 11. The polarities of the two side branches of the armature are opposed to the polarity of the central branch. The polarities of the two pole pieces do not vary and they are opposed.

In equilibrium, whether current passes through the coil 11 or not, each pole piece 19 butts up against the end of a branch of the armature 20. If current is passing through the coil 11, in the direction opposite to the last passage of current, the polarity of the central branch of the armature varies, as does that of the side branches. The pole piece 19 butting up against the central branch of the armature is then repelled by the central branch of the armature, but also attracted by a side branch. The same applies to the other pole piece, which is repelled by the side branch against which it was resting and which is attracted by the central branch.

The air gaps 21, made of non-magnetic material, allow the attractive force between the pole pieces 19 and the branches of the armature 20 to be adjusted.

Irrespective of the embodiment described hereinabove, the heald shaft 3 of the hook selection device can assume two stable positions—one corresponding to the selection of the corresponding hook 2 and the other to the non-selection of the latter.

In the absence of current through the coil 11, the heald shaft 3 remains in the position in which it lies, whether in a selection or non-selection position. As long as a new electromagnetic field generated by a current of the reverse direction through the coil 11 does not modify the polarity of the part 9 of the heald shaft (FIGS. 1, 2 and 4), or of the pole pieces 12 (FIG. 3) or of the branches of the armature 20 (FIGS. 5 to 7), the heald shaft 3 remains in a stable position.

In these devices, a few milliseconds is all that is required to cause the heald shaft 3 to swing from one position to the other. Selection of the hooks 2 may therefore take place rapidly. Consequently, the consumption of energy is minimized.

As goes without saying, the invention is not limited to the embodiments described hereinabove by way of non-limiting examples but, on the contrary, it encompasses all alternative forms.

Thus, for example, FIGS. 1 and 5 show a box containing only two heald shafts, but it may contain as many heald shafts as desired.

The heald shafts are made of two different materials. However, they could be made just from one magnetic material.

The relative position of the pin of the heald shaft, the coil and the catch is not fixed. The coil could lie, for example, between the pin and the catch.

In -the embodiments, the pole pieces or the branches of the armature serve as stops. The box could incorporate such mechanical stops. The solution adopted in the description hereinabove is a preferred solution but not a mandatory one.

What is claimed is:

1. A device for selecting hooks in a dobby having a bottom board and an upper part, the bottom board carrying the hooks and the upper part supports the device and is adapted to move relative to the bottom board, the device comprising:

a plurality of rigid, heald shafts, each shaft having a catch and at least one portion made of magnetic material, each shaft mountable to the upper part to pivot about a pin and corresponding to a hook of the bottom board;

an electromagnetic control device having at least one coil, the electromagnetic control device controlling the position of each catch relative to the corresponding hook; and means for creating a permanent magnetic field in a region of the portion of each shaft made of magnetic material, wherein the coil acts on the portion of the shaft made of magnetic material such that the shaft pivots about the pin to one of a first position for allowing entrainment of the corresponding hook when the bottom board moves away from the upper part and a second position which does not allow entrainment of the corresponding hook.

2. The device according to claim 1, wherein the heald shaft is made of a material having no magnetic property on a first side of the heald shaft common with the catch and of the magnetic material on a second side of the heald shaft opposite to the catch.

3. The device according to claim 2, wherein the electromagnetic control device includes two pole pieces having a permanent magnet therebetween and part of the portion of the heald shaft made of magnetic material can move between the two pole pieces and is partially surrounded by the coil.

4. The device according to claim 3, wherein the two pole pieces serve as a mechanical stop for the pivoting heald shaft and define two positions between which the heald shaft moves.

5. The device according to claim 2, wherein the electromagnetic control device includes two pole pieces having a second coil therebetween and part of the portion of the heald shaft made of magnetic material can move between the two pole pieces and is partially surrounded by the second coil.

6. The device according to claim 2, wherein the portion of the heald shaft made of a magnetic material is a permanent magnet and the electromagnetic control device includes two pole pieces between which lies the coil and part of the permanent magnet can move.

7. The device according to claim 1, wherein each heald shaft has on a side opposite the catch, a housing to accommodate a permanent magnet placed between two pole pieces projecting from the housing and the electromagnetic control device includes an E-shaped armature where the coil surrounds a central branch of the E-shaped armature, an end of each pole piece projecting out of the housing lying between two branches of the E-shaped armature.

8. The device according to claim 1, wherein each heald shaft has on a side opposite the catch, a housing to accommodate an E-shaped armature, the coil surrounds a central branch of the E-shaped armature and a permanent magnet is placed between two pole pieces facing the E-armature in such a way that one end of each pole piece lies between two branches of the E-shaped armature.

9. The device according to claim 7, wherein an air gap comprising a non-magnetic material is placed between each end of a pole piece and adjacent branches of the E-shaped armature.

10. The device according to claim 1, wherein the electromagnetic control device includes an electronic card having a printed circuit for controlling passage of a current through the coil to allow selection of the position of the heald shaft.

* * * * *